US006505367B2

(12) United States Patent
Griffin et al.

(10) Patent No.: US 6,505,367 B2
(45) Date of Patent: Jan. 14, 2003

(54) BATH TOWEL DEVICE AND METHOD FOR INFANTS

(76) Inventors: Richard Charles Griffin, 5508 Cannon Way, #D, West Palm Beach, FL (US) 33415; Leonie Beverly Griffin, 5508 Cannon Way, #D, West Palm Beach, FL (US) 33415

( * ) Notice: Subject to any disclaimer, the term of this patent is extended or adjusted under 35 U.S.C. 154(b) by 0 days.

(21) Appl. No.: 09/801,553

(22) Filed: Mar. 8, 2001

(65) Prior Publication Data

US 2001/0029631 A1 Oct. 18, 2001

Related U.S. Application Data

(60) Provisional application No. 60/187,858, filed on Mar. 8, 2000.

(51) Int. Cl.[7] ..... A47G 9/00

(52) U.S. Cl. ..... 5/655; 5/421; 5/921; 2/48

(58) Field of Search ..... 5/655, 485, 482, 5/421, 484, 922; 2/48, 49.1, 49.2, 51; D2/861, 864

(56) References Cited

U.S. PATENT DOCUMENTS

| | | | | | |
|---|---|---|---|---|---|
| 2,635,245 | A | | 4/1953 | Nigro | 2/49 |
| 2,850,617 | A | * | 9/1958 | Coldren | 5/421 |
| 3,248,519 | A | * | 4/1966 | Boughton | 5/421 |
| D275,827 | S | | 10/1984 | Henry | D2/864 |
| 4,787,099 | A | | 11/1988 | Mack | 2/49 |
| 5,036,547 | A | | 8/1991 | Silas | 2/49 |
| 5,062,168 | A | | 11/1991 | Kocib | 2/69 |
| 5,075,897 | A | * | 12/1991 | Daniels | 5/654 |
| 5,075,901 | A | | 12/1991 | Vollrath | |
| D325,115 | S | | 4/1992 | Vassar, Sr. | D2/864 |
| 5,640,717 | A | | 6/1997 | Ray | 2/80 |
| 5,652,958 | A | * | 8/1997 | Farrell-Mestas | 2/48 |
| 5,697,102 | A | | 12/1997 | Benjamin | |
| D398,140 | S | | 9/1998 | Lion | |
| 5,855,021 | A | | 1/1999 | Somerville | |
| 5,956,762 | A | * | 9/1999 | Adams | 2/48 |

OTHER PUBLICATIONS

Martha Stewart Living USA.
Little Angel Wings—D,398,140 USA.
Bath N Wrap—USA.

* cited by examiner

*Primary Examiner*—Alexander Grosz
(74) *Attorney, Agent, or Firm*—Stearns Weaver Miller Weissler Alhadeff & Sitterson, P. A; David P. Lhota, Esq.

(57) ABSTRACT

A bath towel device and method for picking up, holding and drying infants and small children, wherein the bath towel includes a strap for hanging the towel from an adults neck, a lower end that wraps around the infant/child, a surface area that covers a substantial portion of an adults torso and lap and means for holding the lower end near the upper end when wrapped around an infant or small child.

8 Claims, 3 Drawing Sheets

BATH TOWEL DEVICE AND METHOD FOR INFANTS

CROSS REFERENCE TO RELATED APPLICATIONS

This application claims the benefit of provisional application Serial No. 60/187,858 filed Mar. 8, 2000.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to bathing accessories, and more specifically to a modified towel that may be worn by an adult while bathing an infant or small child in order to prevent being soaked with bath water during bathing and when removing the infant/child from the bath receptacle, facilitate the safe removal of the child from the bath and allow for the immediate wiping and drying of the infant/child with said towel.

2. Description of the Background Art

Washing or bathing an infant or a small child can be a tedious and wet chore. It typically requires an adult or guardian lowering the infant/child into a bathing receptacle, such as a bath or wash tub or pan, that is filled with a quantity of bath water. The adult must exercise extreme care in the performance of such activity so that the infant or small child is adequately cleaned while being restrained from ingesting water, soap or shampoo and from falling or dropping out of the bathing receptacle. Once bathing is finished, the adult delicately and quickly removes the infant from the bath receptacle taking care to wrap or envelop the infant with a drying towel while trying to minimize the chance of becoming wet or soaked themselves with water splashing up from the bath receptacle and dripping from the infant. As a drying towel is seldom within easy reach, the wet infant must be held with one or both arms while retrieving the drying towel, which exposes the infant to risk of injury and the ambient air. When the towel is positioned within easy reach, it is frequently repositioned by the activity and commotion of the bath, especially if the infant is agitated. As a result, the adult often gets wet or soaked with bath water during removal of the infant/child from the bath and the infant/child is exposed to the ambient air while dripping wet increasing the risk of injury and sickness.

In light of the aforementioned risk and disadvantages present in conventional methods of bathing infants and small children, there exist the need for a modified bath towel that can be more easily accessible to the adult and more convenient to the user. A towel that could be worn by an adult while bathing and drying the infant/child would meet this need as the infant could be picked up with, held against, dried with and wrapped in the towel in an uninterrupted, continuous motion, thereby preventing the adult from becoming soaked with water and unnecessarily exposing the wet infant to the ambient air and risk of dropping and other injury.

Numerous designs for modified towel designs have been provided in the prior art. Even though these designs may be suitable for the specific individual purposes to which they address, they are not suitable for solving the problems addressed by the instant invention as said designs are intended primarily for use as garments. These designs are exemplified by U.S. Pat. No. 5,075,901, Athletic Shirt-Towel Assembly, issued to Vollrath on Dec. 31, 1991; U.S. Pat. No. 5,697,102, Combination Towel and Robe, issued to Benjamin on Dec. 16, 1997; and U.S. Pat. No. 5,855,021, Towel Garment, issued to Somerville on Jan. 5, 1999.

As such, it may be, appreciated that there is a continuing need for a new and improved towel modified to be worn and used by the care-giver to safely pick up, hold and dry the infant/child immediately after removal from the bath. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

BRIEF SUMMARY OF THE INVENTION

Based on the foregoing, it is a primary object of the instant invention to provide a modified towel that may be worn by and hung from an adult while bathing, picking up and drying infants and small children.

It is also an object of the instant invention to provide a towel that facilitates the safe removal of an infant or small child from a bath tub.

It is another object of the instant invention to provide a towel that allows for the immediate wiping and drying of said infant or small child as they are removed from the bath.

It is an additional object of the instant invention to provide a towel that keeps the adult from being soaked with bath water when the infant or small child is bathed and removed from the bath receptacle.

It is a further object of the instant invention to provide a low-cost, easy-to-manufacture, and easy-to-market after-bath towel for infants.

It is another object of the instant invention is to provide an easy-to-use and versatile after-bath towel for infants.

It is an additional object of the instant invention is to provide an after-bath towel for infants that is comprised of a fabric material modified with a neck strap attached to a shorter edge thereon and a pair of fasteners secured to one side of said towel portion.

It is also an object of the instant invention to provide an after-bath towel for infants that prevents said infant/child from becoming unnecessarily exposed to injury and the ambient air while wet.

In light of these and other objects, the instant invention provides a bath towel that may be worn and used by an adult during and after bathing an infant or small child. The preferred embodiment of the instant invention comprises a towel having a releasable, fixed or elastic neck strap attached to or proximal the edge of the towel, a lower end that may be pulled up and over the infant/child and a surface area having a size adapted for substantially covering the lap and torso area of an adult. The towel of the instant invention may further comprise wrap fasteners affixed to the towel for securing a selected edge, such as the lower end, to another section of the towel proximal the strap edge. The wrap fasteners may comprise a narrow, elongate fastener attached proximate to the shorter edge or upper/strap end of the towel and a second narrow, elongate fastener secured proximate to an opposing, cooperating edge on said first side of the towel. The fasteners may comprise VELCRO®, snaps, clips, and the like.

In the preferred embodiment, the towel is substantially rectangular. The towel may also be substantially oval, triangular and/or rounded along selected edges. The towel is preferably manufactured from cotton, terry cloth, hemp or other material having similar water absorption characteristics. The surface area of the towel preferably covers at least the torso area of an adult and provides for adequately wrapping, enveloping or covering an infant. The neck strap is preferably releasable and secured at two points to the upper edge of the towel or on one side of the towel near the upper end. The strap may comprise two cooperating straps each having a fixed end permanently secured to the towel and a free end whereby the free ends include fasteners that releasably connect. The fasteners may comprise VELCRO®, snaps, clips, and the like.

Before bathing an infant, an adult or guardian dons the towel by placing their head through the strap or connecting the strap ends around the neck such that it hangs from the neck with the towel portion covering at least the torso area of the adult. If the towel employs wrap fasteners, the side of the towel with the fasteners attached thereon should be exposed or facing outward. Once the infant/child has been bathed, the adult picks up the infant/child with the towel and places it against the chest in a seamless motion, ensuring that the wet infant makes contact with the majority of the towel. Once so positioned, the adult can raise the lower end of the towel until the infant is adequately covered or wrapped by the towel. To keep the child wrapped and the towel secured, the lower end may be securely joined to the upper end using the wrap fasteners.

In accordance with these and other objects, which will become apparent hereinafter, the instant invention will now be described with particular reference to the accompanying drawings.

BRIEF DESCRIPTION OF THE DRAWINGS

The foregoing objects, features and advantages of the invention wilt become more fully understood from the following description of the preferred embodiment of the invention as illustrated in the accompanying drawings in which like reference characters refer to the same parts throughout different views. The drawings are not necessarily to scale, emphasis instead being placed upon illustrating the principles of the invention.

DETAILED DESCRIPTION OF THE INVENTION

Figure 1:
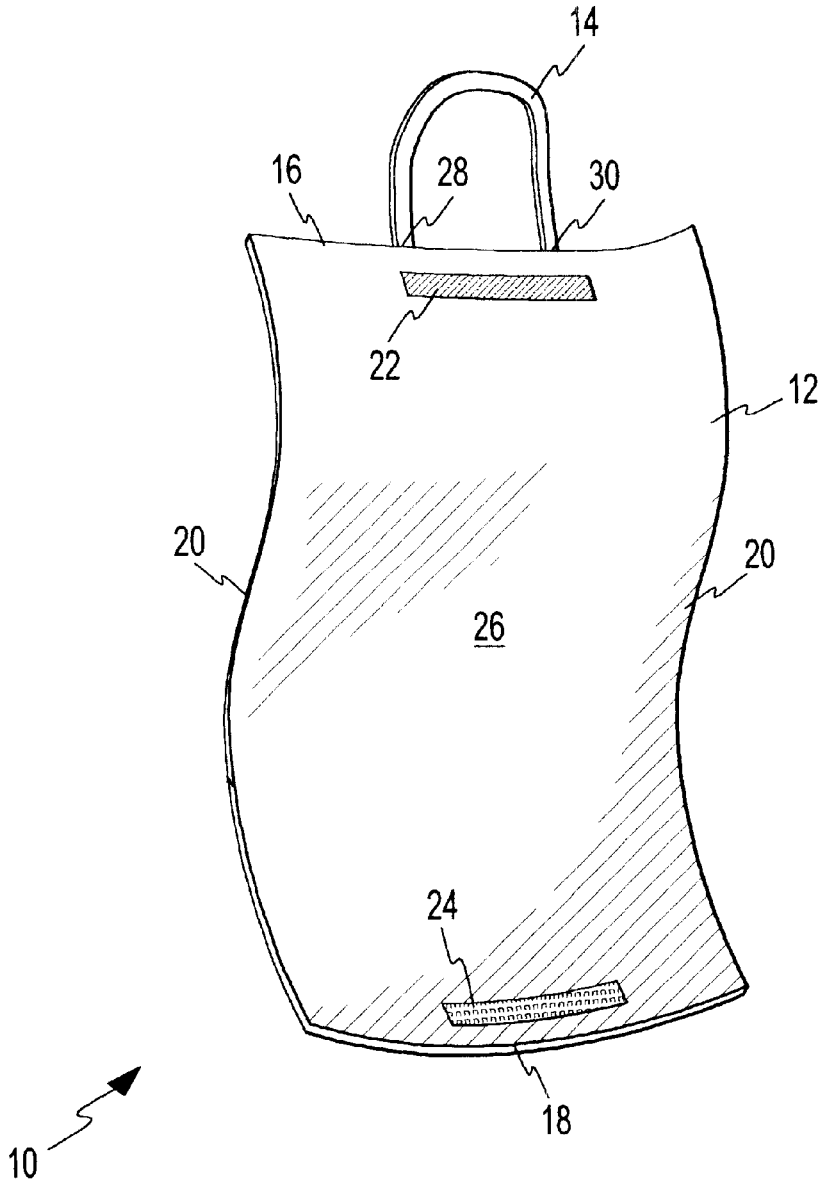
FIG. 1 is a perspective view of the preferred embodiment of the bath towel device and method for infants/children in accordance with the present invention.

With reference to the drawings, FIGS. 1–4 depict the preferred and alternative embodiments of the towel device of the instant invention which is generally characterized by the referenced numeral 10. Referring to FIG. 1, instant invention 10 comprises a substantially rectangular, water absorbent bath towel 12 and a flexible neck strap 14 attached thereto. Although the towel 10 is shown and described as rectangular, it may also be substantially oval or triangular or it may have rounded corners. The bath towel 10 is constructed with a shorter upper edge 16 (upper in this description referring to the area of the towel closest to the neck strap 14 or neck of the wearer), shorter bottom edge 18, and two longer lateral side edges 20. The preferred material of construction comprises material that is sufficiently soft, water absorbent, durable, and attractive, including soft cotton pile, terry cloth, hemp and the like. The neck strap 14 preferably comprises a soft, flexible, resilient material, such as woven textiles, soft rubber or plastic, and the like. A first, elongate fastener 22 is attached proximate to the top edge 16 and in parallel relation thereto, and a second elongate fastener 24 is attached proximate to the bottom top edge 18 in parallel. Both fasteners 22, 24 are secured onto a first side 26 of the towel. Said fasteners 22, 24 are of the quick release and attachment type, such as hook and loop, known by the trade name VELCRO®, or snaps, clips, zippers, and like. The neck strap 14 is secured at opposing ends 28, 30 to the towel 12 by various means and fastening devices, such as stitching, rivets, buttons, and the like.

Figure 4:
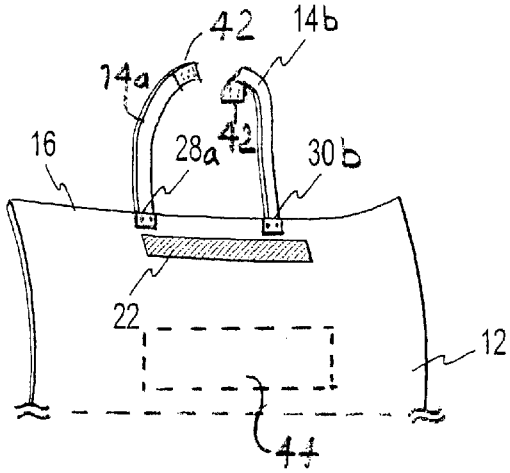
FIG. 4 is a partial perspective view of an alternative embodiment of the neck strap.

The neck strap 14 may also comprise two straps 14*a*, 14*b* each having a fixed end attached to the towel 10 and a free end that fasten together, as shown in FIG. 4. Fasteners 42 are attached to the free end of the straps for joining once the towel has been positioned on the person's body. The fasteners 42 may comprise hook-and-loop (such as VELCRO®), snaps, clips, zippers, tie-straps and like. In another alternative embodiment, the towel 10 may comprise a heating element 44, which may be battery powered, as shown in FIG. 4. In another alternative embodiment, the neck strap 14 may have one fixed end, such as at 28 or 30, and an opposite free end having a fastener, such as one of those disclosed herein, that releasably attaches to a corresponding fastener, such as 28*a* or 30*a*, on the towel 10 that is affixed to the towel a predetermined distance from the fixed end.

Figure 2:
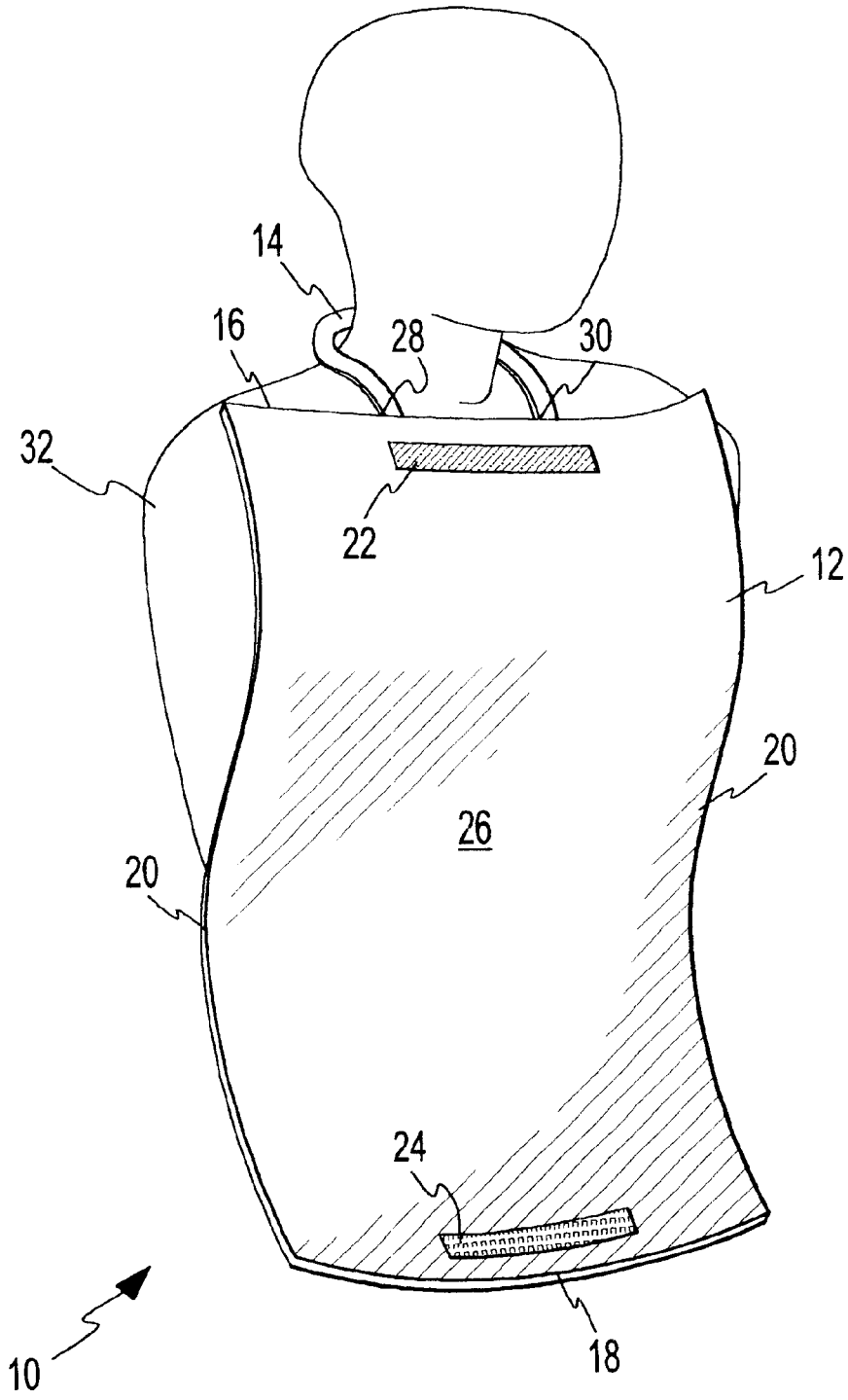
FIG. 2 is a perspective view of the preferred embodiment of the bath towel as worn by an adult user before placement of an infant thereon in accordance with the present invention.
Figure 3:
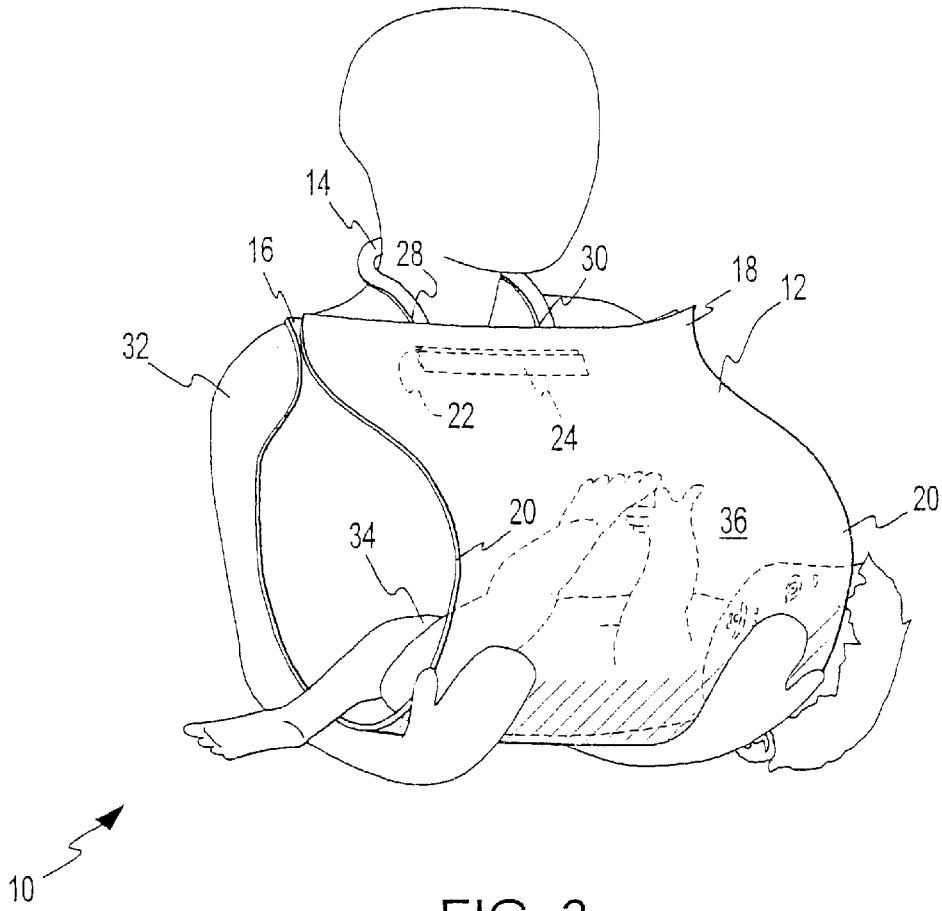
FIG. 3 is a perspective view of the preferred embodiment of the towel as worn by an adult user with an infant secured within the towel in accordance with the present invention.

Referring to FIG. 2, the bath towel 10 is mounted to or worn by an adult user 32 placing the strap 14 around the adult's neck. The neck strap 14 is placed over and down past the head of the adult or secured behind the adult's neck and rests substantially upon and around the shoulders and neck of the adult user 32. The body of the towel 10 has a length and width that substantially covers an adults torso and which may also cover the lap area. Accordingly, the towel 10 should have a length of approximately two to five feet and width of two to three feet. When worn, the body of the towel 10 depends downward from the attached ends 28, 30 of the neck strap 14 and covers at least the torso and preferably a substantial portion of the torso and lap area of the adult 32. In this configuration and position of the towel 10, the adult 32 can wash an infant within a bath receptacle in an unobstructed manner and without getting wet. In FIG. 3, the adult user 32 is shown holding an infant 34 in the towel 10. As illustrated, the infant 34 is removed from a bath receptacle (not shown) and placed substantially against the first side 26 of the towel 10 at which time the bottom 18 edge of the towel 12 is pulled toward the top edge 16. As a result, the towel substantially encloses and dries the infant 34. The arms of the adult user 32 can be positioned in a manner that swaddles the infant 34 under normal circumstances with a reduced risk of the infant slipping and falling. Once the infant is adequately wrapped and enclosed by the towel 12, the top 16 and bottom 18 edges are pressed together in substantial parallel relation so that the fasteners 22, 24 are releasably engaged in order to retain the towel 12 in a folded configuration around the infant 34. Once the infant 34 is secured, the second side 36 of the towel 12 is substantially exposed to view. While drying is occurring, the adult 32 can support the infant 34 with arms extended as illustrated and then place the infant 34 onto a surface at which time the fasteners 22, 24 are disengaged, and the infant 34 can be separated from the towel 12 portion. Referring to FIG. 3, the second side 36 may include pouches 42 for holding items, such as cotton swabs and/or creams, so the adult can readily access such desired items.

While this version of the invention has been illustrated and described in detail in the drawings and foregoing description, the same is to be considered as illustrative and not restrictive in character. With respect to the above description, it is to be realized that the optimum dimensional relationships for the parts of the invention may include variations in size, materials, shape, form, function and manner of operation, assembly and use.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A bath towel for infants and young children adapted for wearing by an adult care giver while giving and removing an infant from a bath, said towel comprising:

a flexible, fabric-based material capable of absorbing water;

an upper end and lower end defined by said material, said material comprising a first surface between said upper and lower ends;

a body defined by said material between said upper and lower ends; and a strap having at least one end affixed to said material and means for mounting around the adult's neck;

a first fastener attached to said first surface below and proximal to said upper end;

a second corresponding fastener attached to said first surface below said first fastener and above said lower end;

at least one pocket attached to a second surface for storing items; and means for heating said material, said heating means be disposed in said material.

2. A towel as recited in claim 1, wherein said strap is affixed to said upper end.

3. A towel as recited in claim 1, wherein said strap is affixed proximal to said upper end.

4. A towel as recited in claim 1, wherein said strap comprises:

a first strap having a fixed end attached at least proximal to said upper end and a free end having a first fastener; and a second strap having a fixed end attached to said material a predetermined distance from said first strap and a free end having a corresponding fastener that mates with said first fastener; said first fastener and said corresponding fastener cooperating for attachment behind the adult's neck to secure said material to the adult.

5. A towel as recited in claim 4, wherein said first and corresponding fasteners comprise hook-and-loop.

6. A towel as recited in claim 1, wherein said strap comprises:

two fixed ends attached to said material at least near said upper end and defining an opening that receives the adult's head and neck.

7. A towel as recited in claim 6, wherein said strap comprises a flexible and stretchable material for creating said opening.

8. A towel as recited in claim 1, wherein said first and second fasteners comprise hook-and-loop.

* * * * *